US008016215B1

(12) United States Patent
Zhadanov et al.

(10) Patent No.: US 8,016,215 B1
(45) Date of Patent: Sep. 13, 2011

(54) HEAD FOR SHOWERING AND THE LIKE

(76) Inventors: Sam Zhadanov, Brooklyn, NY (US); Eli Zhadanov, Brooklyn, NY (US)

( * ) Notice: Subject to any disclaimer, the term of this patent is extended or adjusted under 35 U.S.C. 154(b) by 0 days.

(21) Appl. No.: 12/800,404

(22) Filed: May 15, 2010

(51) Int. Cl.
*B05B 1/18* (2006.01)
*B05B 1/26* (2006.01)
*B05B 1/14* (2006.01)
*B05B 15/08* (2006.01)

(52) U.S. Cl. ..... 239/544; 239/536; 239/543; 239/556; 239/567; 239/587.6

(58) Field of Classification Search ..... 239/536, 239/548, 552, 556–559, 567, 587.1, 587.5, 239/587.6, 390, 391, 418, 420, 422, 423, 239/428, 433, 543, 544
See application file for complete search history.

(56) References Cited

U.S. PATENT DOCUMENTS 6,042,027 A * 3/2000 Sandvik ..... 239/422
7,055,767 B1 * 6/2006 Ko ..... 239/587.4

* cited by examiner

*Primary Examiner* — Darren W Gorman
(74) *Attorney, Agent, or Firm* — I. Zborovsky

(57) ABSTRACT

A showerhead has a housing provided with an inlet for flowing of water into the housing and a plurality of openings; and a plurality of adjustable inserts associated with the openings, provided with water channels, and formed so that the inserts are individually movable to change their orientation so as to change a trajectory of a jet issued from each individual insert the inserts being formed so that water flowing out from the channels of each of the inserts forms as a single jet.

5 Claims, 2 Drawing Sheets

A–A

HEAD FOR SHOWERING AND THE LIKE

BACKGROUND OF THE INVENTION

The present invention relates to a showerhead for showering and the like.

Known showerheads are conventionally formed as elements which issue a plurality of jets through corresponding openings in their front surface. The showerheads provide do not provide adjustability of the individual jets, while it is desirable to adjust the jets for generating various actions desired by users. It is believed that the existing showerheads can be further improved.

SUMMARY OF THE INVENTION

Accordingly, it is an object of the present invention to provide a showerhead which is a further improvement of the existing showerheads.

In keeping with these objects and with others which will become apparent hereinafter, one feature of the present invention resides, briefly stated, in a showerhead, comprising a housing provided with an inlet for flowing of water into the housing and having a plurality of openings; and a plurality of inserts associated with said openings, provided with channels and formed so that said inserts can individually change their orientation to change a trajectory of a jet issued from each individual insert, and each insert has a plurality of channels through which water flows in individual jets that can be oriented toward one another to form a single jet.

Another feature of the present invention resides in that the inserts are located at a radial distance from the axis of the housing over a circumference around said axis and spaced from one another in a circumferential direction.

A further feature of the present invention resides in each of said inserts having an outlet and being turnable about two axis extending substantially transversely to each other and transversely to said axis of said housing.

A further feature of the present invention resides in that each of said inserts has a concave surface on which outlets of its channels are provided so that water flowing out of the channels unites in a single jet.

A further feature of the present invention resides in that said inserts are movable so that two water jets issuing from said outlets of said inserts can be oriented to unite in at least one common water jet.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
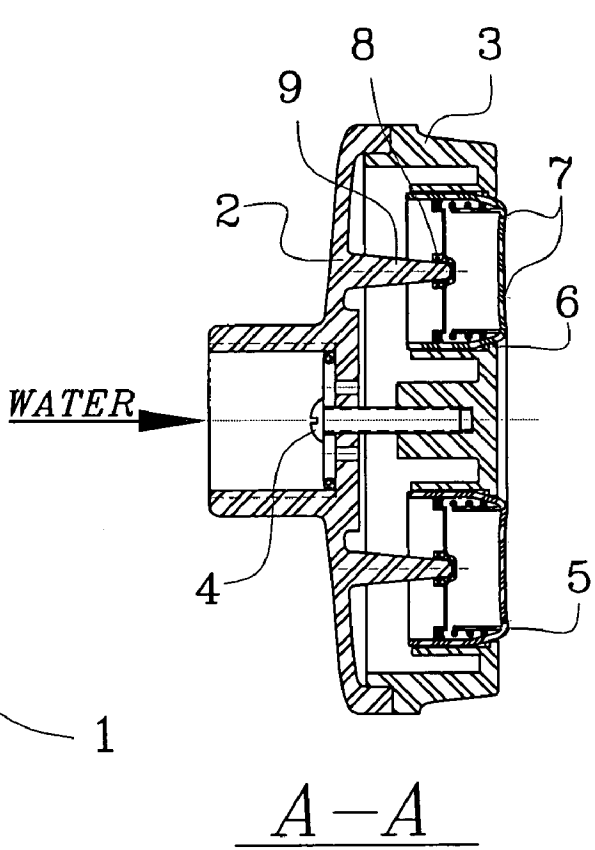
FIG. 2 is a transverse cross-section of the showerhead in accordance with the present invention.
Figure 1:
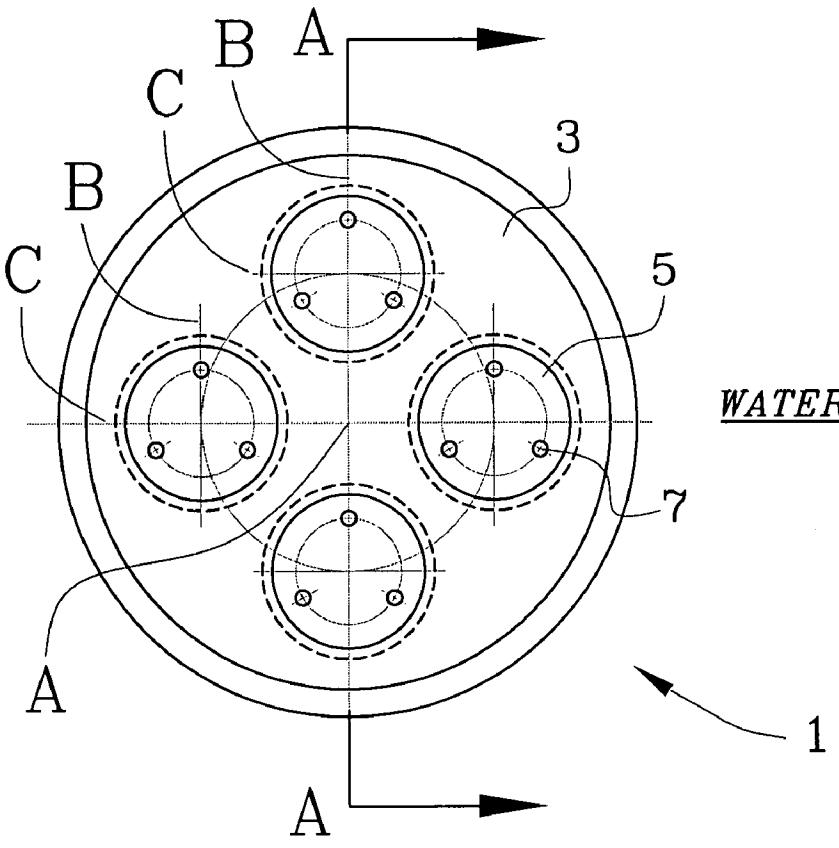
FIG. 1 is a front view of a showerhead in accordance with the present invention.
Figure 4:
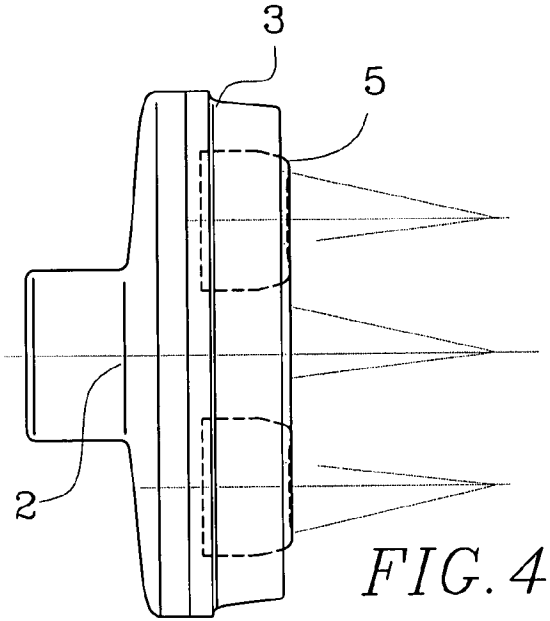
FIGS. 4 and 5 are side views of the showerhead with two different orientations of the inserts.
Figure 3:
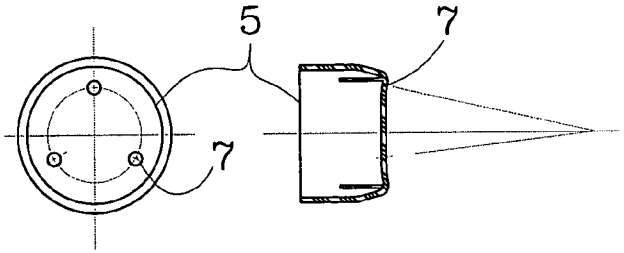
FIG. 3 is a view showing a cross-section of an insert of the inventive showerhead.
Figure 5:
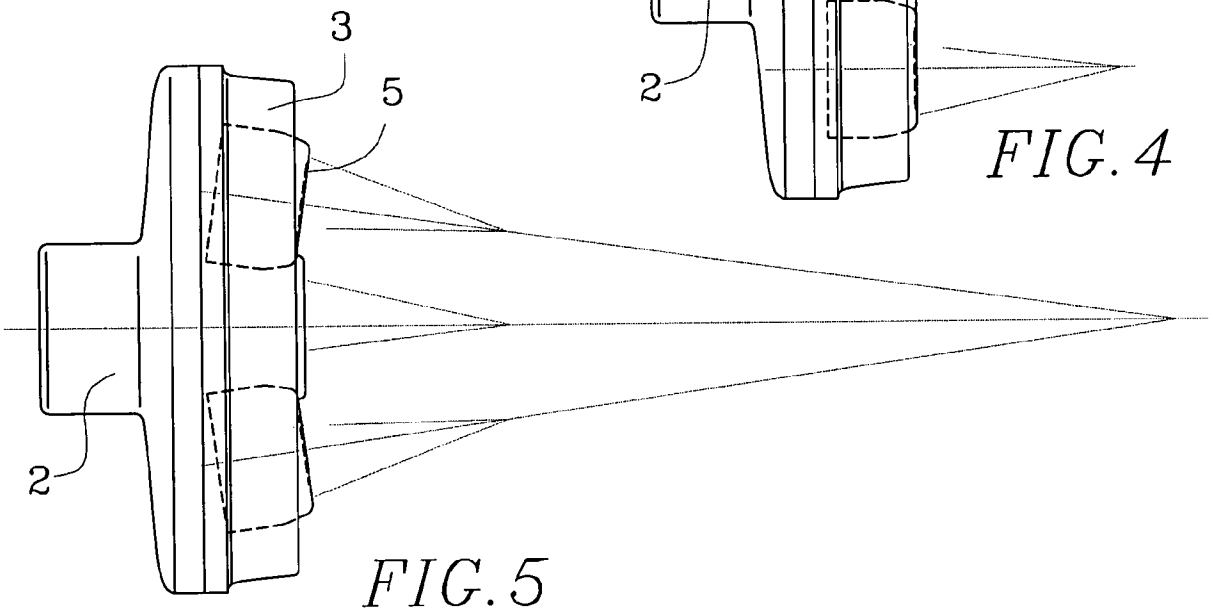

A showerhead in accordance with the present invention is identified as a whole with reference numeral 1. The showerhead has a housing which is composed of two parts, namely a housing part 2 and a cover part 3 connectable with one another to define a hollow space therebetween. The cover part 3 can be connected to the housing part 2 for example by a screw 4. An inlet pipe can be inserted into the inlet opening of the housing part to supply water into its interior.

The showerhead further has a plurality of inserts identified with reference numeral 5 and each inserted in a receptacle 6. The receptacles 6 are arranged preferably over a circumference around a central axis A of the housing of the showerhead and distances from the axis, and therefore the inserts 5 are also spaced from one another in a circumferential direction and located around the axis A.

Each insert 5 has channels 7. Water entering an interior of the housing 2, 3 flows into the channel of each insert, flows through the insert and issues from is channels.

Each inserts 5 has a portion 8 with which it is movable supported on a projection 9 of the housing. Each insert 5 is arranged on the projection 9 so that it can turn relative to the housing around an axis B which is transverse to the axis A of the showerhead and/or around an axis C which is transverse to the axis B and also transverse to the axis A of the showerhead, and also around the axes between them.

Since the inserts are arranged on the projections 9 relatively tightly therefore, when turned, they maintain their orientation.

The outer surface of each insert 5 is concave. Therefore when water flows through each insert and exits through its channels, for example 3 channels the outflowing jets are directed toward one another and form from each insert a single jet.

The inserts 5 are turnable individually or separately from one another. Therefore, the water jets issued from inserts can be oriented in different directions. They can be all oriented so that they all form a single jet, they can be oriented so that some of the inserts can form one common jet while other of the inserts form another common jets, or they can be oriented so that all of them issue jets which are not united in any way with the other jets, etc.

The various orientations of the inserted can be simply selected by a user by turning the inserts about corresponding axis.

When the showerhead is designed in accordance with the present invention, it provides for a possibility of adjusting the water issuing from the head not only by turning the head as a whole, but also by individually turning the inserts to provide a desired pattern of water action.

It is therefore possible to combine several water jets flowing out of each insert into one single jet, and then to combine each single jets of all inserts into a common single water jet provided by the device. Such common jet is very powerful, and located close to the device.

It will be understood that each of the elements described above, or two or more together, may also find a useful application in other types of constructions differing from the type described above.

While the invention has been illustrated and described as embodied in a head for showering and the like, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A showerhead, comprising a housing provided with an inlet for flowing of water into the housing and a plurality of openings; and a plurality of adjustable inserts associated with said openings, provided with water channels, wherein said inserts being formed so that water flowing out from said channels of each of said inserts forms as a single jet, and wherein said inserts are movable so that said single jets from said outlets of channels of said inserts are orientable to unite in a common water let.

2. A showerhead as defined in claim 1, wherein said housing has an axis, said inserts being located at a radial distance from said axis over a circumference around said axis and spaced from one another in a circumferential direction.

3. A device as defined in claim 1, wherein each of said inserts has a concave outer surface on which outlets of said channels are located, so that water flowing out of said outlets of said channels of each of said inserts forms the single jet.

4. A showerhead, comprising a housing provided with an inlet for flowing of water into the housing and a plurality of openings; and a plurality of adjustable inserts associated with said openings, provided with water channels, and formed so that said inserts are individually movable to change their orientation so as to change a trajectory of a jet issued from each individual insert, said inserts being formed so that water flowing out from said channels of each of said inserts forms a single jet, wherein each of said inserts has a concave outer surface on which outlets of said channels are located, so that water flowing out of said outlets of said channels of each of said inserts forms the single jet, wherein said inserts are movable so that said single jets from said outlets of channels of said inserts are orientable to unite in a common water jet and an outer surface of the shower head includes an outer surface of said housing with inclusions of a plurality of individual concave surfaces of said inserts.

5. A showerhead, comprising a housing provided with an inlet for flowing of water into the housing and a plurality of openings; and a plurality of adjustable inserts associated with said openings, provided with water channels, and formed so that said inserts are individually movable to change their orientation so as to change trajectory of a jet issued from each individual insert, wherein each of said inserts has a concave outer surface on which outlets of said channels are located, so that water flowing out of said outlets of said channels of each of said inserts forms a single jet directed into a single point, wherein said inserts are movable so that said single jets from said outlets of channels of said inserts are orientable to unite in a common water jet directed into a common single point.

* * * * *